US006644978B2

(12) United States Patent
Araki

(10) Patent No.: US 6,644,978 B2
(45) Date of Patent: Nov. 11, 2003

(54) CONNECTOR HAVING TWO CONNECTORS INSERTED INTO ONE LEAD BLOCK

(75) Inventor: Shunji Araki, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 10/136,134

(22) Filed: May 1, 2002

(65) Prior Publication Data

US 2002/0168885 A1 Nov. 14, 2002

(30) Foreign Application Priority Data

May 8, 2001 (JP) ..... 2001-136813

(51) Int. Cl.[7] ..... H01R 39/00
(52) U.S. Cl. ..... 439/15; 439/164
(58) Field of Search ..... 439/15, 164

(56) References Cited

U.S. PATENT DOCUMENTS 5,238,420 A * 8/1993 Miyahara et al. ..... 439/164
5,562,466 A 10/1996 Kato et al. ..... 439/15
5,702,266 A 12/1997 Jones ..... 439/15
6,271,515 B1 8/2001 Matsumoto ..... 439/15
6,299,454 B1 * 10/2001 Henderson et al. ..... 439/15
6,354,853 B1 * 3/2002 Matsuzaki et al. ..... 439/164

* cited by examiner

*Primary Examiner*—Tho D. Ta
(74) *Attorney, Agent, or Firm*—Brinks Hofer Gilson & Lione

(57) ABSTRACT

In the rotary connector, at least one of the first and second lead blocks includes a holding member and a plurality of terminals having connection terminal portions which are projected outwardly from the holding member, respective terminal portions of the flexible cable are connected to a plurality of terminals, a plurality of terminals are formed of at least two, that is, first and second groups of terminals, and, at different positions on first and second straight lines which are placed in parallel with each other with a given distance between them, distal ends of respective connection terminal portions of the first and second groups of terminals are arranged in parallel to each other.

5 Claims, 5 Drawing Sheets

CONNECTOR HAVING TWO CONNECTORS INSERTED INTO ONE LEAD BLOCK

BACKGROUND OF THE INVENTION

1. Field of the Invention

The present invention relates to a rotary connector which is mounted on a steering device of an automobile or the like and is used as electric connection means between electric apparatuses such as a steering heater and an air bag system mounted on a car body of an automobile.

2. Description of the Related Art

To explain a drawing which shows a conventional rotary connector, FIG. 6 is a plan view showing the conventional rotary connector.

The rotary connector 60 is incorporated in a steering apparatus of an automobile or the like (not shown in the drawing) and is employed as electrical connection means for a steering heater circuit mounted in a steering wheel, an airbag circuit, a horn circuit and other switching circuits. The rotary connector 60 is basically comprised of a pair of a stationary housing 61 and a movable housing 62, both being disposed coaxially and connected together so as to be rotatable relative to each other, a flexible cable (not shown in the drawing) housed in an annular cable accommodating portion (not shown in the drawing) formed between a pair of these stationary and movable housings 61, 62 such that a flexible cable can be wound and unwound in the space, and a first and a second single lead blocks 63, 64 which are respectively connected to both ends of the flexible cable.

The flexible cable (not shown in the drawing) is constructed such that a plurality of (for example, six) of conductors made of an extremely thin strip-like copper foil or the like, each conductor being interposed between two sheets of insulating films as a strip-like base film, are disposed in parallel with each other and stuck to the insulating films.

The rotary connector 60 having such a basic construction is further fabricated as follows: fix the stationary housing 61 to a car body (not shown in the drawing) while fixing the movable housing 62 to a steering wheel member (not shown in the drawing); and further connect both ends of the flexible cable to associated electric devices on the sides of the car body and the steering wheel member via respective first and second lead blocks 63, 64 arranged at the stationary side and the movable side; thus realizing electrical connection means for a heater circuit device for steering apparatus, a vehicle-mounting airbag system and a horn circuit.

The stationary housing 61 made of synthetic resin material includes a cylindrical outer cylinder 65, a bottom wall 66 which is formed on an end of the outer cylinder 65, and one first accommodating portion 67 which is projected outwardly from a position in the vicinity of an outer peripheral end of the bottom wall 66.

On the other hand, the movable housing 62 made of synthetic resin material includes a cylindrical inner cylinder 68, an upper wall 69 which is formed on an end of the inner cylinder 68, and one second accommodating portion 70 which is projected outwardly from a position in the vicinity of an outer peripheral end of the upper wall 69.

The first lead block 63 includes a holding member 63*a* made of synthetic resin material and a plurality (for example, six) of terminals 63*b* made of metal material which are formed in the holding member 63*a* by insert molding. These terminals 63*b* are provided with connection terminal portions 63*c* which are projected outwardly from the holding member 63*a*. These connection terminals 63*c* are extended outwardly in a straight manner from proximal portions thereof which are connected to the holding members 63*a*. Further, these connection terminals 63*c* are arranged in parallel on a straight line S2 equidistantly in a row.

The first lead block 63 is held in the first accommodating portion 67 of the stationary housing 61 and one end of one (1 piece) flexible cable (not shown in the drawing) is electrically and mechanically connected to each terminal 63*b*.

The second lead block 64 includes a holding member 64*a* made of synthetic resin material and a plurality (for example, six) of terminals 64*b* made of metal material which are formed in the holding member 64*a* by insert molding. These terminals 64*b* are provided with connection terminal portions 64*c* which are projected outwardly from the holding member 64*a*. These connection terminal portions 64*c* are extended outwardly in a straight manner from proximal portions thereof which are connected to the holding members 64*a*. Further, these connection terminals 64*c* are arranged in parallel on a straight line S3 equidistantly in a row.

The second lead block 64 is held in the second accommodating portion 70 of the movable housing 62 and the other end of one (1 piece) flexible cable (not shown in the drawing) which is connected to the terminal 63*b* is electrically and mechanically connected to each terminal 64*b*.

Then, with respect to respective terminals 63*b*, 64*b* of the above mentioned first and second lead blocks 63, 64, two connectors consisting of, for example, a first connector for a steering heater circuit (not shown in the drawing) and a second connector for an air bag circuit and a horn circuit (not shown in the drawing) are respectively inserted into the first and the second accommodating portion 67, 70 thus establishing the electrical connections.

However, in the above mentioned conventional rotary connector, each connection terminal portion is configured such that two connectors are respectively inserted into one lead block which is extended along one straight line in a straight manner and hence, there arises a problem that these two connectors are erroneously inserted in such a manner that the left position is mistaken for the right position.

SUMMARY OF THE INVENTION

Accordingly, it is an object of the present invention to solve the above mentioned problems and to provide a rotary connector which can securely connect respective connectors to given connecting terminal portions when two connectors are respectively inserted into one lead block.

According to the rotary connector of first aspect of the present invention, the rotary connector substantially comprises a stationary housing on which a first lead block is mounted, a movable housing on which a second lead block is mounted and is rotatably mounted with respect to the stationary housing, and a flexible cable which is accommodated inside an accommodating portion formed between the stationary housing and the movable housing, wherein at least one of the first and second lead blocks includes a holding member and a plurality of terminals having connection terminal portions which are projected outwardly from the holding member, respective terminal portions of the flexible cable are connected to a plurality of terminals, a plurality of terminals are formed of at least two, that is, first and second groups of terminals, and, at different positions on first and second straight lines which are placed in parallel with each other with a given distance between them, distal ends of respective connection terminal portions of the first and second groups of terminals are arranged in parallel to each other.

Due to such a constitution, when two connectors are respectively inserted into one lead block, respective connectors can be securely connected to given connection terminal portions.

According to the rotary connector of a second aspect of the present invention, respective proximal portions of respective connection terminal portions connected with the holding member are arranged in parallel on the straight lines, the bends are formed on respective connection terminal portions of the first group of terminals and respective connection terminal portions of the second group of terminals are formed in a straight manner.

Due to such a constitution, by providing the bends to respective connection terminal portions of the first group of terminals, the positions of the first and second groups of terminals can be easily made different from each other so that the rotary connector can be provided at a low cost.

Further, according to the rotary connector of a third aspect of the present invention, the second lead block includes the first and the second groups of terminals having the connection terminal portions which are arranged in parallel at different positions on the first and second straight lines.

Due to such a constitution, by providing the connection terminal portions to the movable housing at which connectors are connected by insertion and disconnected by pulling frequently, it is possible to provide the rotary connector which can securely connect the connectors to the first and the second groups of terminals.

Further, according to the rotary connector of a fourth aspect of the present invention, the rotary connector includes two connectors which are respectively connected to the first and the second groups of terminals, and a guide which guides the insertion of the connector is formed on the movable housing.

Due to such a constitution, respective connectors to be inserted can be securely guided by the guide and hence, it is possible to provide the rotary connector with no erroneous insertion of respective connectors.

Further, according to the rotary connector of a fifth aspect of the present invention, distances between positions of the first and the second straight lines on which the respective connection terminal portions are formed and a center line of the guide parallel to the first and second straight lines are set different from each other.

Due to such a constitution, it is possible to provide the rotary connector with no erroneous insertion of respective connectors and with the reliable connection.

Further, according to the rotary connector of a sixth aspect of the present invention, the rotary connector includes two pieces of the first lead blocks which are mounted on the stationary housing and one piece of the second lead block which is mounted on the movable housing, ends of the flexible cable which are connected to the first group of terminals of the second lead block are connected to the terminals of one first lead block out of two lead blocks, and ends of the flexible cable which are connected to the second group of terminals are connected to the terminals of the other first lead block out of two lead blocks.

Due to such a constitution, by mounting two pieces of the first lead blocks to the stationary housing, it is possible to provide a rotary connector which can securely connect separate connectors which are connected to different electric apparatuses to the first lead block.

DETAILED DESCRIPTION OF THE PREFERRED EMBODIMENTS

Figure 1:
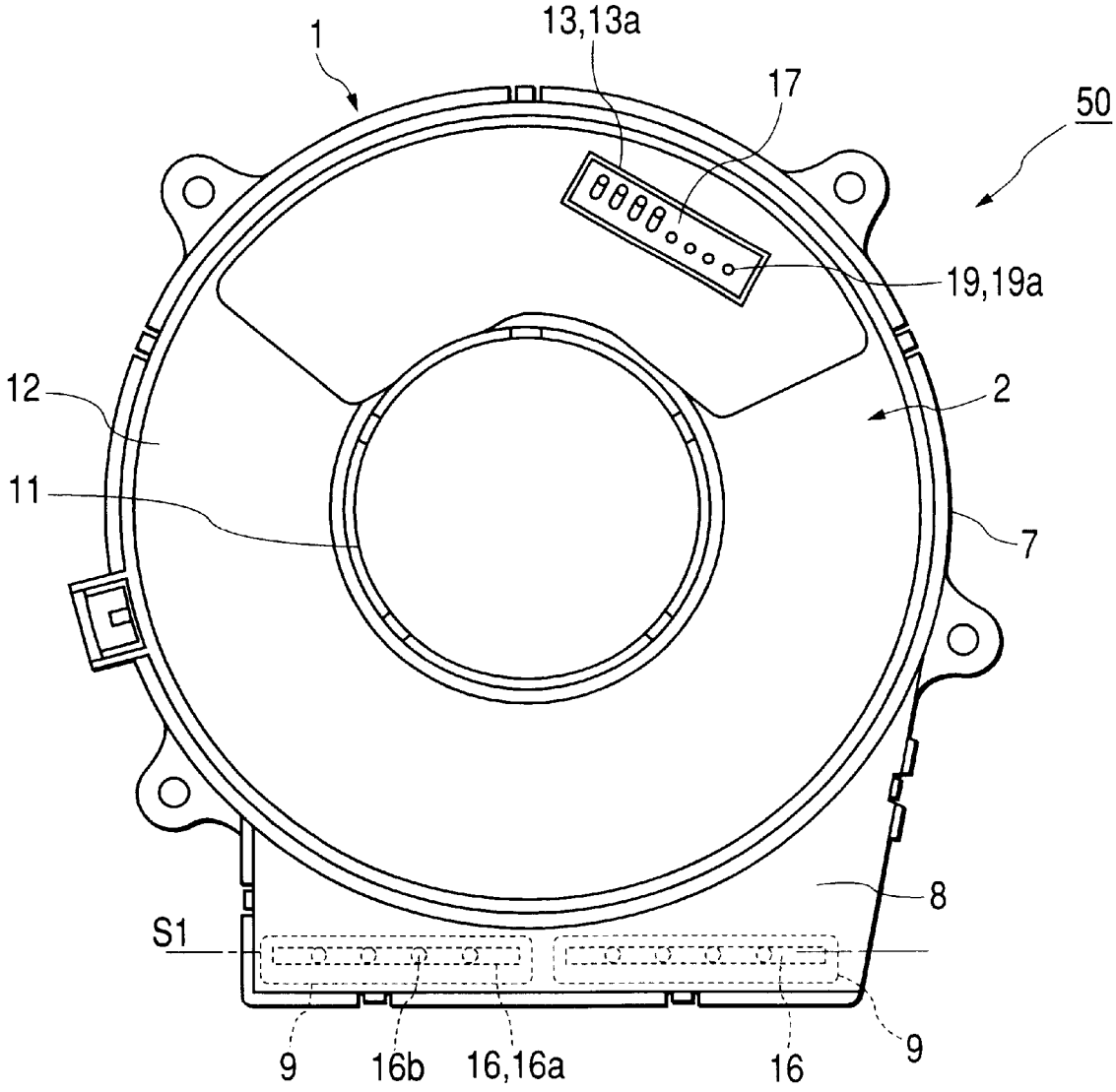
FIG. 1 is a plan view showing a rotary connector of the present invention.
Figure 2:
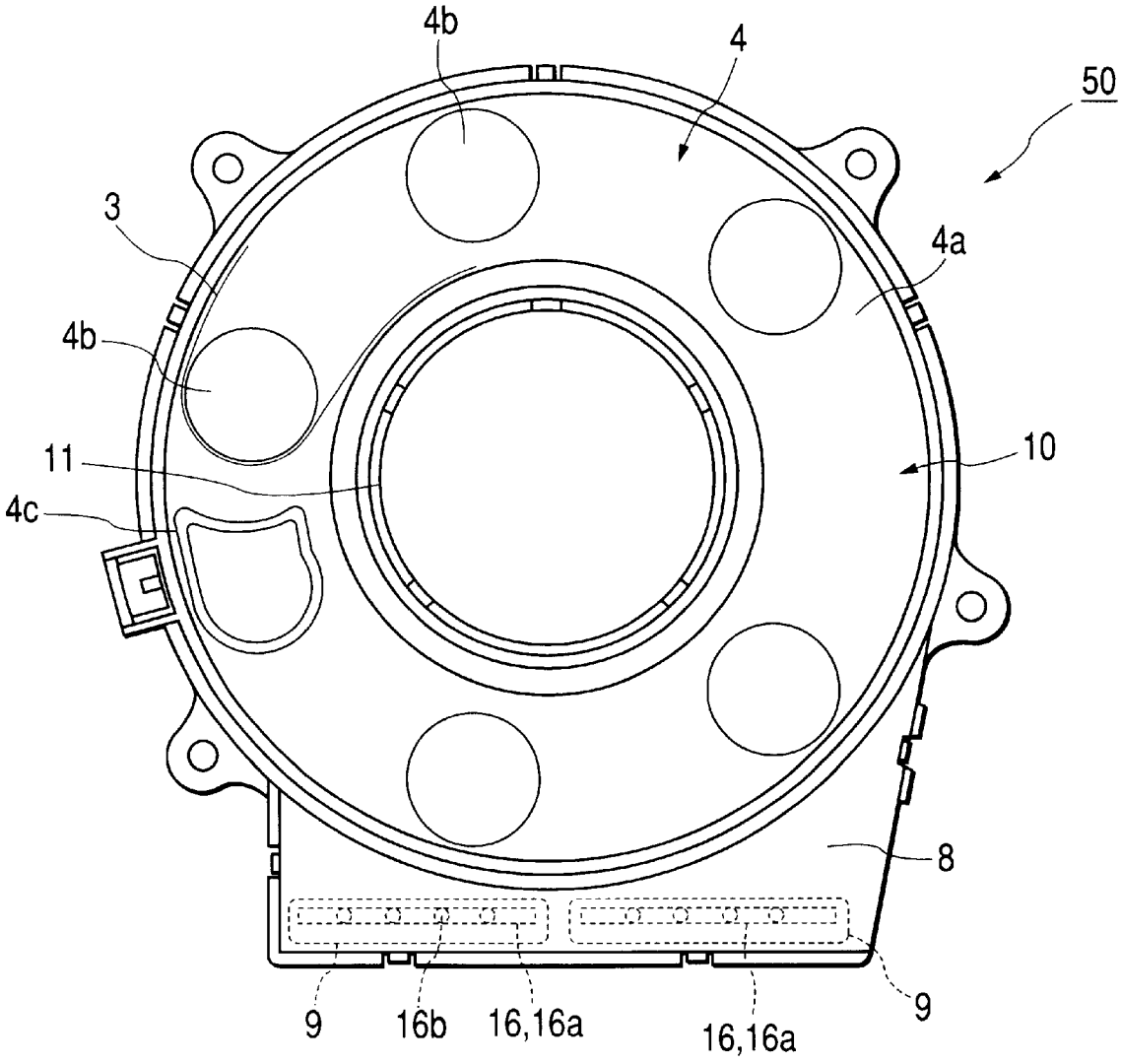
FIG. 2 is a plan view showing a stationary housing and a movable body according to the rotary connector of the present invention.
Figure 3:
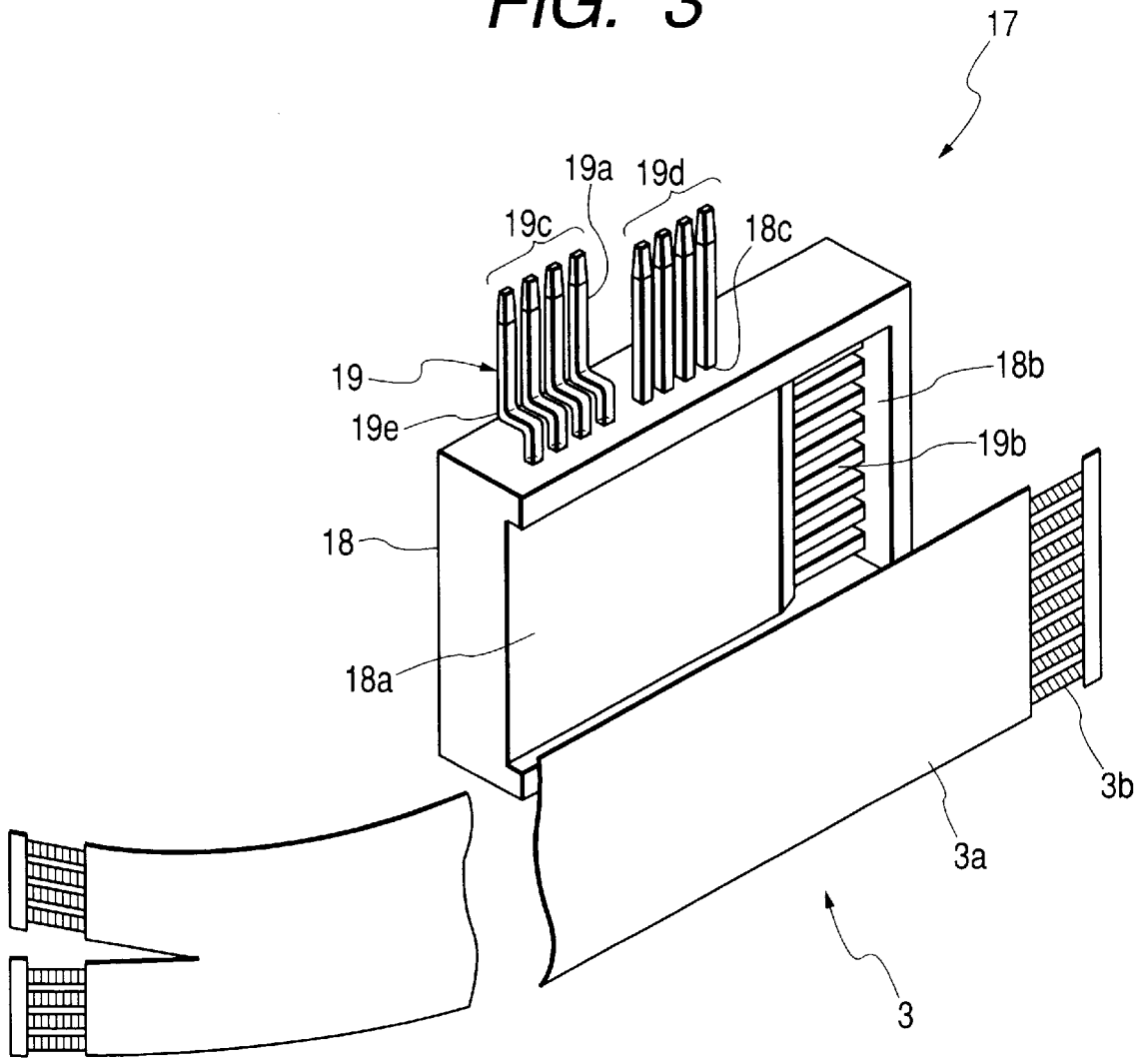
FIG. 3 is a perspective view showing a lead block and a flexible cable according to the rotary connector of the present invention.
Figure 4:
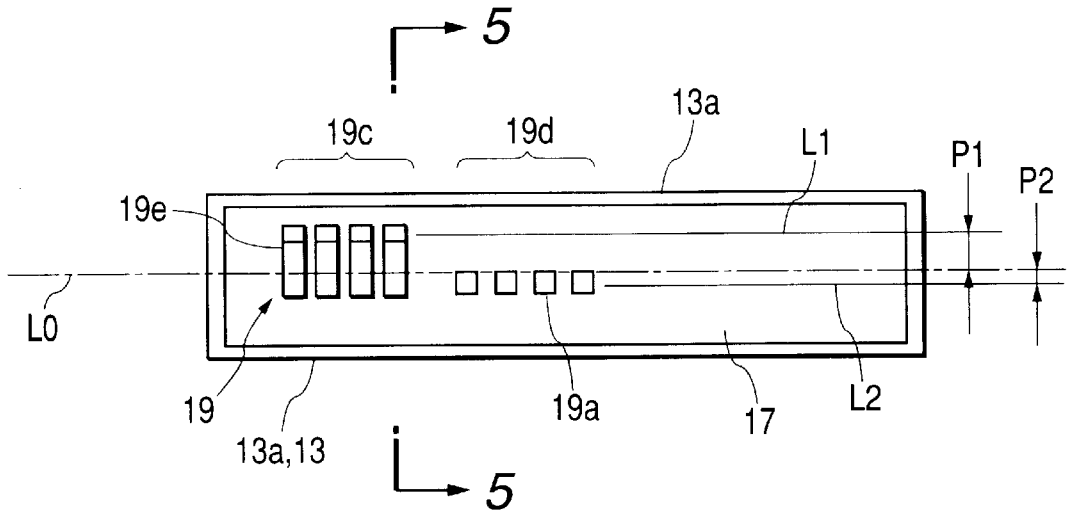
FIG. 4 is an explanatory view for explaining the lead block and an accommodating portion according to the rotary connector of the present invention.
Figure 5:
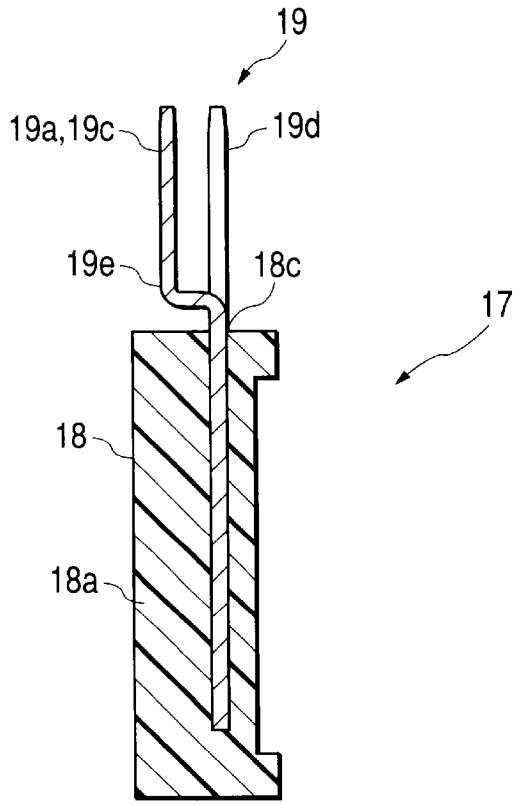
FIG. 5 is a cross-sectional view taken along a line 5—5 of FIG. 4.
Figure 6:
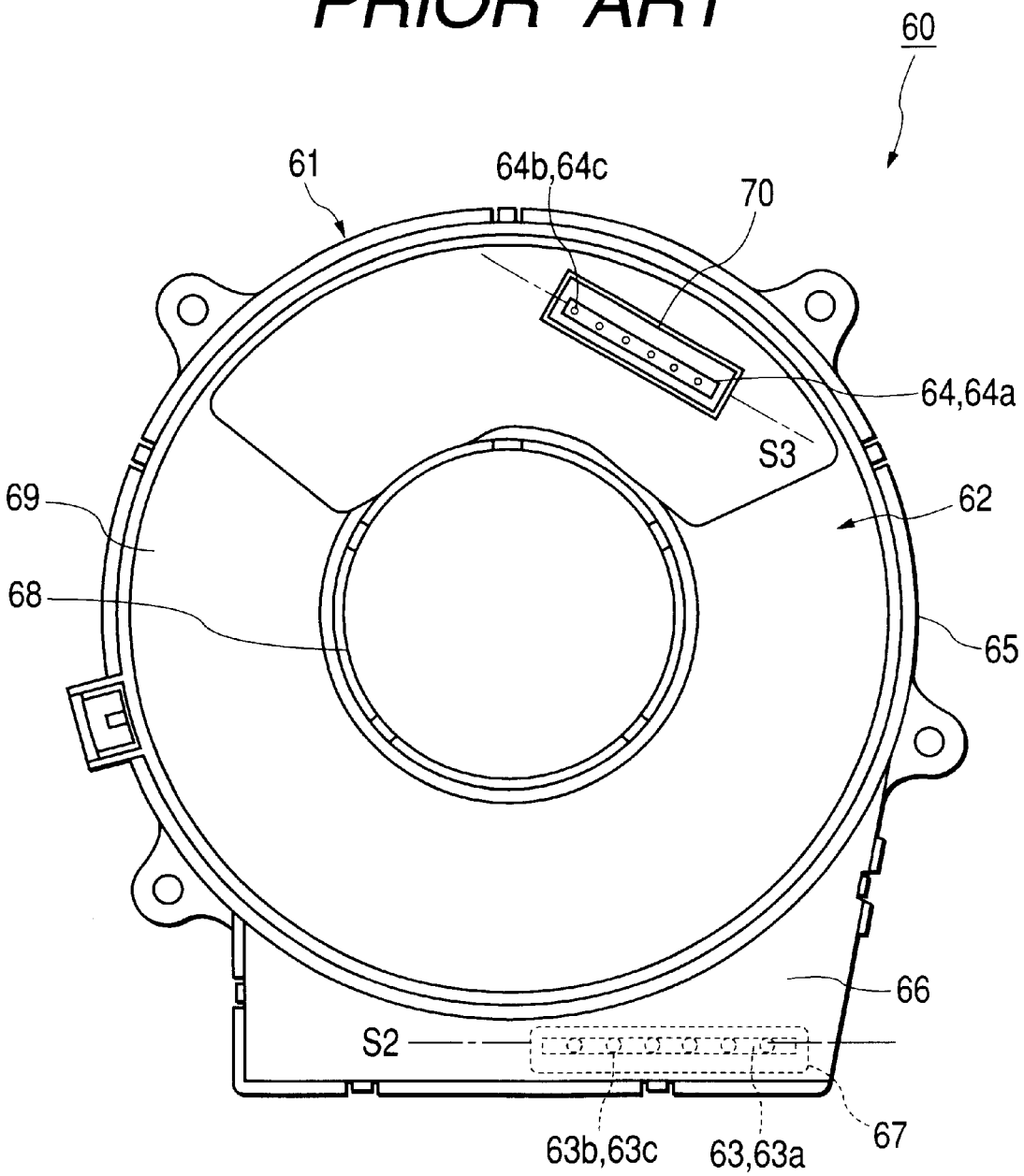
FIG. 6 PRIOR ART
FIG. 6 is a plan view showing a conventional rotary connector.

An embodiment of a rotary connector according to the present invention is explained in detail in conjunction with FIG. 1 to FIG. 6 hereinafter. FIG. 1 is a plan view showing a rotary connector of the present invention, FIG. 2 is a plan view showing a stationary housing and a movable body according to the rotary connector of the present invention, FIG. 3 is a perspective view showing a lead block and a flexible cable according to the rotary connector of the present invention, FIG. 4 is an explanatory view for explaining the lead block and an accommodating portion according to the rotary connector of the present invention, and FIG. 5 is a cross-sectional view taken along a line 5—5 of FIG. 4.

A rotary connector 50 of the present invention is substantially comprised of a stationary housing 1, a movable housing 2 which is rotatably mounted with respect to the stationary housing 1, a flexible cable 3 which is accommodated in the inside of an accommodating portion 10 formed between the stationary housing 1 and the movable housing 2, a movable body 4 which is rotatably arranged between the stationary housing 1 and the movable housing 2, and first and second lead blocks 16, 17 to which respective ends of the flexible cable 3 are connected.

The stationary housing 1 made of synthetic resin material includes a cylindrical outer cylinder 7, a bottom wall 8 which is mounted on an end of the outer cylinder 7, and two first cylindrical accommodating portions 9 which are projected outwardly from a position in the vicinity of an outer peripheral end of the bottom wall 8. Further, with respect to the first accommodating portion 9, a guide (not shown in the drawing) is formed by a cylindrical inner peripheral surface.

On the other hand, the movable housing 2 made of synthetic resin material includes a cylindrical inner cylinder 11, an upper wall 12 which is mounted on an end of the inner cylinder 11, and one cylindrical second accommodating portion 13 which is projected outwardly from a position in the vicinity of an outer peripheral end of the upper wall 12. Further, with respect to the second accommodating portion 13, a guide 13*a* which guides the insertion of connectors (not shown in the drawing) is formed by a cylindrical inner peripheral surface.

The outer cylinder 7 and the inner cylinder 11 are coaxially arranged, an annular accommodating portion 10 is formed between these outer and inner cylinders 7, 11, and the movable body 4 is arranged in the inside of the accommodating portion 10.

The movable body 4 made of synthetic resin material is arranged in the inside of the accommodating portion 10 such that the movable body 4 is movable in the circumferential direction thereof. The movable body 4 includes a circular annular holding portion 4*a,* a plurality of rotary members 4*b* which are rotatably mounted on the holding portion 4*a,* and a guide member 4*c* which is disposed close to a given rotary member 4*b* and guides the flexible cable 3 while reversing flexible cable 3 so as to prevent the buckling thereof.

The flexible cable 3 is formed such that a plurality (for example, eight) of conductors 3*b* made of extremely thin strip-like copper foils or the like are laminated to each other in parallel between two insulation films 3*a* constituting strip-like base films and both ends of each conductor 3*b* are exposed from the insulation films 3*a*. Further, one end of the flexible cable 3 is formed such that the insulation films 3*a* and a plurality (for example, eight) of conductors 3*b* are bifurcated and respective conductors 3*b* are formed in a two-piece state by being divided into two sets each consisting of four pieces, for example, while the other end of the flexible cable 3 is formed in the one-piece state in which the insulation films 3*a* and a plurality (for example, eight) of conductors 3*b* are integrally formed.

The first lead block 16 includes a holding member 16*a* made of synthetic resin material and a plurality (for example, four) of terminals 16*b* made of metal material which are formed on the holding member 16*a* by insert molding.

Further, connection terminal portions (not shown in the drawing) which constitute ends of respective terminals 16*b* are arranged such that the connection terminal portions are projected outwardly from the holding member 16*a* in a straight manner. The connection terminal portions are extended straightly from proximal ends thereof which are connected to the holding member 16*a* and are arranged on one straight line S1 in parallel equidistantly in a row. Here, two first lead blocks 16 are arranged. The terminal 16*b* of each first lead block 16 is electrically and mechanically connected to respective four conductors 3*b* formed in a bifurcated manner at one end of the flexible cable 3.

Then, the first lead blocks 16 are respectively disposed into the inside of two first accommodating portions 9 of the stationary housing 1. In this state, the terminals 16*b* of the first lead blocks 16 are accommodated in the inside of the first accommodating portions 9.

The second lead block 17 includes a holding member 18 made of synthetic resin material and a plurality (for example, eight) of terminals 19 made of metal material which are formed on the holding member 18 by insert molding. Further, the holding member 18 is formed in an approximately rectangular shape and includes a base 18*a* and an approximately rectangular hole 18*b* which is formed in one end side of the base 18*a*. Further, the terminals 19 include connection terminal portions 19*a* which are projected outwardly from the base 18*a* of the holding member 18 and connection portions 19*b* which are extended in an L shape from the connection terminal portions 19*a* and are exposed in the inside of the holes 18*b*. Further, respective proximal portions 18*c* of respective connection terminal portions 19*a* which are connected to the holding member 18 are arranged in parallel on a straight line.

Further, a plurality (for example, eight) of terminals 19 are, as shown in FIG. 3, constituted of a first group of terminals 19*c* formed of a plurality (for example, four) of terminals 19 and a second groups of terminals 19*d* formed of plurality (for example, four) of terminals 19. With respect to these first and second group of terminals 19*c,* 19*d,* respective connection terminals portions 19*a* of the first and the second groups of terminals 19*c,* 19*d* are arranged in parallel on first and second straight lines L1, L2 which are arranged in parallel with a given distance therebetween at positions different from each other.

Further, respective connection terminal portions 19*a* of the first group of terminals 19*c* are respectively provided with bends 19*e* in the vicinity of the proximal portions 18*c* of respective connection terminal portions 19*a,* while distal ends of the bends 19*e* are extended in a straight manner, and respective connection terminal portions 19*a* of the second group of terminals 19*d* are extended in the straight manner from the proximal ends 18*c*. Due to the provision of the bends 19*e* of the first group of terminals 19*c,* respective connection terminal portions 19*a* of the first and the second groups of terminals 19*c,* 19*d* are arranged in the parallel state on the first and the second straight lines L1, L2 at the different positions.

Respective connection portions 19*b* of respective terminals 19 of the second lead block 17 are respectively electrically and mechanically connected to eight of respective conductors 3*b* provided to the other end of the flexible cable 3. In this state, with respect to eight of respective conductors 3*b* connected to respective terminals 19, four of respective conductors 3*b* which constitute one half are connected to the first group of terminals 19*c* formed of respective terminals 19 and four of respective conductors 3*b* constituting the remaining half are connected to the second group of terminals 19*d* formed of respective terminals 19.

Then, the second lead block 17 is disposed in the inside of the second accommodating portion 13 of the movable housing 2. In this state, respective connection terminal portions 19*a* of respective terminals 19 of the second lead block 17 are accommodated in the inside of the guide 13*a* of the second accommodating portion 13. Further, the positions of the first and the second straight lines L1, L2 on which the groups of terminals which are constituted of respective connection terminal portions 19*a* are arranged such that the distances from the center line L0 (zero) of the guide 13*a* which are parallel to the first and the second straight lines L1, L2 to the first and the second straight lines L1, L2 become different from each other.

To be more specific, assuming the distance between the center line L0 (zero) extending in the longitudinal direction of the guide 13*a* and the first straight line L1 on which respective connection terminal portions 19*a* of the first group of terminals 19*c* are positioned as P1 and assuming the distance between the center line L0 (zero) of the guide 13*a* and the second straight line L2 on which respective connection terminal portions 19*a* of the second group of terminals 19*d* are positioned as P2, the first and second straight lines L1, L2 are positioned such that the distance P1 is larger than the distance P2 (P1>P2). That is, the distances which are extended from the cylindrical inner surface which constitutes the guide 13*a* to the first and the second straight lines L1, L2 are made different from each other.

Further, respective connectors which are different from each other are connected to respective connection terminal portions 19*a* of the first and the second groups of terminals 19*c,* 19*d.*

Here, in the above mentioned embodiment of the present invention, although a plurality (for example, eight) of terminals 19 are divided into two groups of terminals consisting of the first and the second groups of terminals 19*c,* 19*d,* the present invention is not limited to such a constitution and the terminals 19 may be divided into three or more groups of terminals.

Further, in the above mentioned embodiment of the present invention, although the bends are formed on respective connection terminal portions of the first group of terminals 19*c* and respective connection terminal ends are arranged on the first and the second straight lines which are arranged in parallel with a given distance therebetween thus constituting different lines from each other, the present invention is not limited to such a constitution and bends formed of arcuate portions or inclined portions, for example, may be formed and distal ends of the arcuate portions or the inclined portions may be extended in a straight manner.

Further, in the above mentioned embodiment of the present invention, although the constitution which forms the bends 19*e* of the first group of terminals 19*c* at the outside of the holding member 18 is disclosed, the present invention is not limited to such a constitution. That is, the bends 19*e* may be formed in the inside of the holding member 18 or the bends 19*e* may be formed in a plurality of groups of terminals rather than forming the bends 19*e* only on the first group of terminals 19*c*.

Still further, in the above mentioned embodiment of the present invention, although the first and the second groups of terminals 19*c,* 19*d* are provided to only a plurality (for example, eight) of the terminals 19 of the second lead block 17, the invention is not limited to such a constitution. For example, two groups of terminals, that is, the first and the second groups of terminals may be provided to the terminals 16*b* of the first lead block 16 and respective terminals of the first and the second groups of terminals may be arranged on the different straight lines.

As has been described heretofore, according to the rotary connector of the present invention, at least one of the first and second lead blocks includes the holding member and a plurality of terminals having connection terminal portions which are projected outwardly from the holding member, respective terminal portions of the flexible cable are connected to a plurality of terminals, a plurality of terminals are formed of at least two, that is, first and second groups of terminals, and, at different positions on the first and second straight lines which are placed in parallel with each other with a given distance between them, distal ends of respective connection terminal portions of the first and second groups of terminals are arranged in parallel to each other, whereby it is possible to provide the rotary connector which can securely connect respective connectors to given respective connection terminal portions when two connectors are respectively inserted into one lead block.

Further, according to the rotary connector of the present invention, respective proximal portions of respective connection terminal portions connected with the holding member are arranged in parallel on the straight lines, the bends are formed on respective connection terminal portions of the first group of terminals and respective connection terminal portions of the second group of terminals are formed in a straight manner. Since the bends are formed on respective connection terminal portions of the first group of terminals, it is easy to change the positions of the first and second groups of terminals so that the rotary connector can be provided at a low cost.

What is claimed is:

1. A rotary connector comprising a stationary housing on which a first lead block is mounted, a movable housing on which a second lead block is mounted and is rotatably mounted with respect to the stationary housing, and a flexible cable which is accommodated inside of an accommodating portion formed between the stationary housing and the movable housing, wherein at least one of the first and second lead blocks includes a holding member and a plurality of terminals having connection terminal portions which are projected outwardly from the holding member, wherein respective terminal portions of the flexible cable are connected to the plurality of terminals, the plurality of terminals having at least first and second groups of terminals, distal ends of respective connection terminal portions of the first group of terminals are arranged along a first line and distal ends of the respective connection terminal portions of the second groups of terminals are arranged along a second line, the first and second lines are parallel with each other and are separated by a given distance, proximal portions of the respective connection terminal portions of both the first and second group of terminals connected with the holding member are arranged along the second line, bends are formed in the respective connection terminal portions of the first group of terminals, and the respective connection terminal portions of the second group of terminals extend straight from the proximal portions to the distal ends.

2. A rotary connector according to claim 1, wherein the bends in the respective connection terminal portions of the first group of terminals are formed the vicinity of the proximal portions of the respective connection terminal portions of the first group of terminals.

3. A rotary connector according to claim 1, wherein the second lead block includes the first and the second groups of terminals having the connection terminal portions which are arranged in parallel at different positions on the first and second straight lines.

4. A rotary connector according to claim 3, wherein the rotary connector includes two connectors which are respectively connected to the first and the second groups of terminals, and a guide which guides the insertion of the connector is formed on the movable housing.

5. A rotary connector according to claim 4, wherein distances between positions of the first and the second straight lines on which respective connection terminal portions are formed and a center line of the guide parallel to the first and second straight lines are set different from each other.

* * * * *